US005183196A

United States Patent [19]

Miyashita

[11] Patent Number: 5,183,196

[45] Date of Patent: Feb. 2, 1993

[54] STAPLER ASSISTOR

[76] Inventor: Mitsuo Miyashita, 67-72, Matsugo, Tokorozawa-shi, Saitama-ken, Japan

[21] Appl. No.: 813,605

[22] Filed: Dec. 26, 1991

[51] Int. Cl.[5] ..... B25C 5/02

[52] U.S. Cl. ..... 227/63; 227/144; 227/156

[58] Field of Search ..... 173/156, 108, 120, 144, 173/63, 124, 129; 81/177.2, 427.5; 30/232, 341

[56] References Cited

U.S. PATENT DOCUMENTS

| | | | |
|---|---|---|---|
| 519,859 | 5/1894 | Fréchette | 227/144 |
| 1,479,908 | 1/1924 | Goshia | 30/341 |
| 2,089,572 | 8/1937 | Polzer | 227/120 |
| 2,675,989 | 4/1954 | Vogel | 227/63 |
| 2,859,443 | 11/1958 | Jopp | 227/124 |
| 2,982,966 | 5/1961 | La Point et al. | 227/63 |
| 4,288,019 | 9/1981 | Dahle | 227/156 |
| 4,838,470 | 6/1989 | Chang | 227/156 |
| 5,046,381 | 9/1991 | Mueller | 30/232 |

*Primary Examiner*—Frank T. Yost
*Assistant Examiner*—Scott A. Smith
*Attorney, Agent, or Firm*—Spencer, Frank & Schneider

[57] ABSTRACT

A stapler assistor for holding a stapler and assisting the driving of the stapler having first and second levers which cross each other at their intermediate portions and pivotally connected to each other at the crossing point through a shaft. One end of the first lever forms an upper jaw while the other end of the first lever forms a lower handle. One end of the second lever forms a lower jaw while the other end forms an upper handle. The upper and lower jaws define therebetween a V-shaped opening for receiving the stapler such that the V-shaped opening of the stapler is oriented in the same direction as the V-shaped opening defined by the upper and lower jaws. The lower jaw is provided with a stopper projection formed on the upper front end thereof so as to prevent the stapler from coming off the stapler assistor. At least one of the upper and lower jaws being provided with protrusions formed near both lateral sides thereof so as to prevent the stapler from moving laterally. The upper stapler is provided in the rear end thereof with a slit for receiving a remover on the rear end of the stapler when the stapler is made to slide rearward along the lower jaw.

10 Claims, 5 Drawing Sheets

STAPLER ASSISTOR

BACKGROUND OF THE INVENTION

1. Field of the Invention

The present invention relates to a stapler and, more particularly, to a stapler assistor which holds a stapler to facilitate driving of the same.

2. Description of the Related Art

Staplers are widely used for the purpose of binding paper sheets or document sheets. Among the various sizes and types of staplers, hand-held staplers, which are used for binding sheet stacks of comparatively small thickness, are the most popular.

When paper sheets are to be bound at a position near a marginal edge of the paper, a hand-held stapler is preferable because the user can hold the entire stapler with the hand and exert a full gripping force on the stapler. In contrast, when the stack of paper is to be bound at a portion which is remote from the marginal edge, the user is obliged to pinch the stapler with the fingers or to place the stapler on a desk or the like and press the lever of the stapler with the palm. Otherwise the user's hand interferes with the paper. Driving of the stapler by use of the fingers alone is quite inefficient, particularly among those who have small hands, because it is difficult to exert the driving force required. Consequently, users are often obliged to use both hands.

Often, stapling work consisting of repeatedly and consecutively binding papers, e.g., packaging papers, is undertaken by female or older workers who may lack the endurance or strength to perform the task without sustaining heavy fatigue, particularly at their fingers.

Hand-held staplers also encounter problems when they are used for binding comparatively hard sheets, e.g., plastic sheets. In such a case, the user is required to use both hands or to press the stapler with the palm. Applying the driving force by this method tends to cause a deviation of the stapling position from the aimed position, as well as mis-registration of the lever arms of the stapler, resulting in a shorter life of the stapler. When the stapler is used for such objects, it is necessary that a strong driving force be rapidly applied; otherwise the staple may bend or buckle before penetrating the stack to be bound. Once the stapler is jammed with a bent staple, much work is required to remove it.

SUMMARY OF THE INVENTION

Accordingly, an object of the present invention is to provide a stapler assistor which enables the user to exert full driving force with one hand so that the paper sheets and so forth can correctly be bound, even at a position remote from the marginal edge. This will facilitate binding work even for those having small hands or those who are not strong, thereby relieving the worker from fatigue.

To this end, according to one aspect of the present invention, there is provided a stapler assistor for holding a stapler and assisting the driving of the stapler, comprising first and second levers which cross each other at their intermediate portions and are pivotally connected to each other at their crossing point by a shaft. One end of the first lever forms an upper jaw while the other end of the first lever forms a lower handle. One end of the second lever forms a lower jaw while the other end forms an upper handle. Furthermore the upper and lower jaws define therebetween a V-shaped opening for receiving the stapler, such that the V-shaped opening of the stapler is oriented in the same direction as the V-shaped opening defined by the upper and lower jaws. Additionally, the lower jaw is provided with a stopper projection formed on the upper front end thereof so as to prevent the stapler from coming off the stapler assistor. Moreover, at least one of the upper and lower jaws is provided with protrusions formed near both lateral sides thereof so as to prevent the stapler from moving laterally. The lower jaw is provided in the rear end thereof with a slit for receiving a remover on the rear end of the stapler when the stapler is inserted in the lower jaw.

The above and other objects, features, and advantages of the present invention will become clear from the following description of the preferred embodiments, when the same is read in conjunction with the accompanying drawings.

DESCRIPTION OF THE PREFERRED EMBODIMENTS

Figure 1:
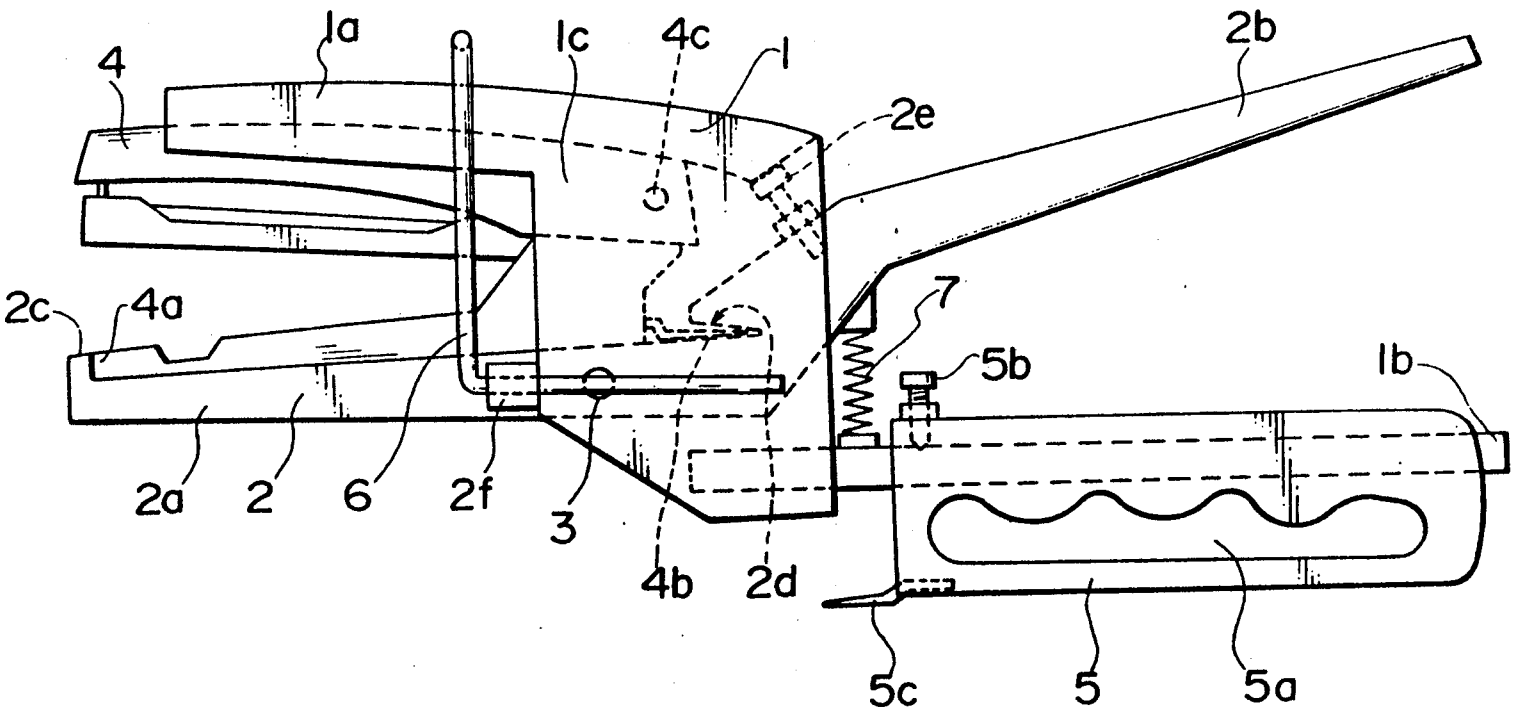
FIG. 1 is a side elevational view of a first embodiment of the stapler assistor in accordance with the present invention.
Figure 2:
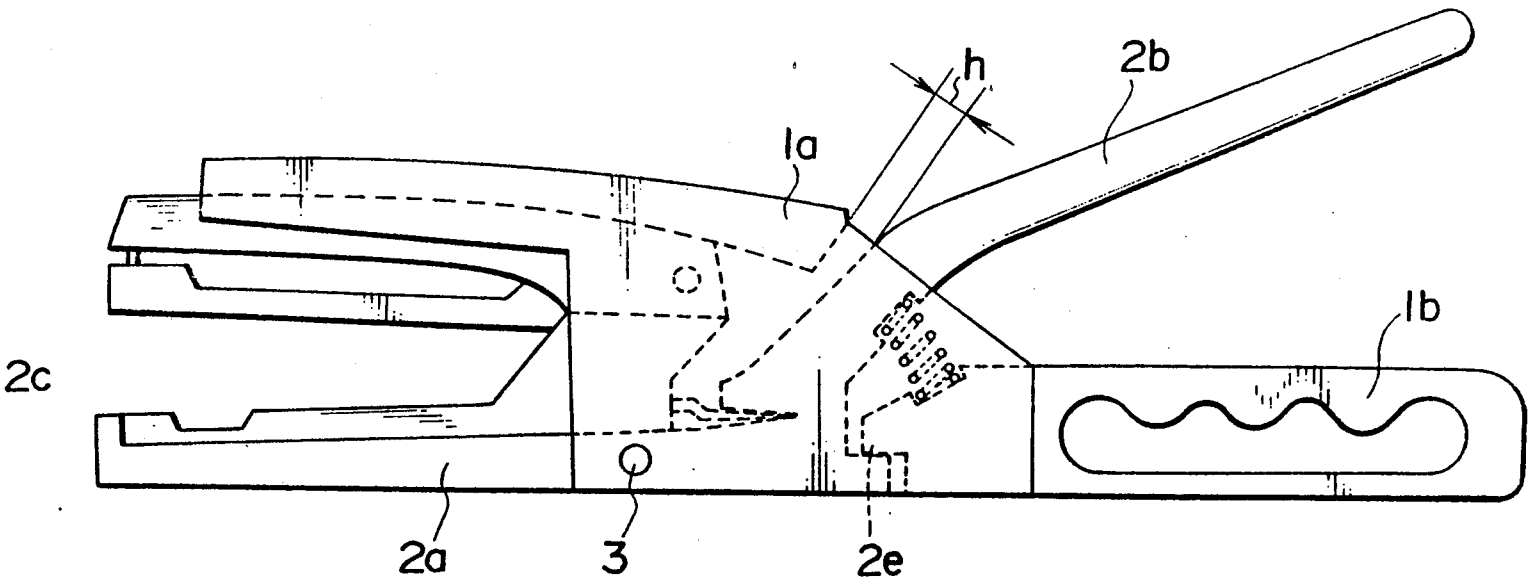
FIG. 2 is a side elevational view of a second embodiment of the stapler assistor in accordance with the present invention.
Figure 3:
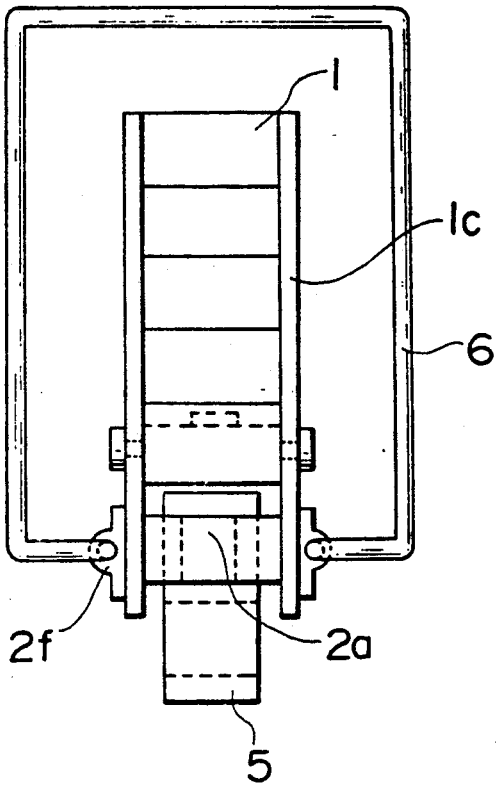
FIG. 3 is a front elevational view of the embodiment shown in FIG. 1.

FIGS. 1 and 2 show first and second embodiments of the stapler assistor with staplers mounted therein, whereas, in FIG. 3, which is a front elevational view of the first embodiment, the stapler has been omitted.

Referring to the drawings, a first lever 1 and a second lever 2 are pivotally connected to each other through a pin 3. Front ends of the levers 1 and 2, i.e., the ends which are adjacent to the paper stack to be bound, provide an upper jaw 1*a* and a lower jaw 2*a*, respectively, while the rear ends of levers 1 and 2 form upper handle portion 2*b* and lower handle portion 1*b*, respectively. A hand-held stapler 4 is placed between the upper jaw la and lower jaw 2*a*. The front lower edge 4*a* of the stapler 4 abuts a projection 2*c* provided on the lower jaw 2*a*. Thus, the projection 2*c* serves as a stopper which prevents the stapler 4 from coming off the stapler assistor in the forward direction.

A staple remover 4*b*, which is formed on the rear end of the stapler 4, is received in a small slit 2*d* which is formed in the rear end of the lower jaw 2*a*. Stapler 4 is thereby prevented from moving towards the lower handle portion 1*b*, and the upper handle portion 2*b*, as well as from moving up and down and to the left and right.

A jaw opening limiting abutment 2e, which acts between the levers 2 and 1, limits the maximum jaw opening, i.e., the space formed between upper jaw 1a and lower jaw 2a, to a level smaller than that of the stapler 4. Consequently, the upper and lower outer surfaces of the stapler 4 are pressed at moderate pressure to the inner surfaces of the upper jaw 1a and lower jaw 2a of the stapler assistor by the force produced by a return spring incorporated within the stapler. Thus, the stapler 4 is securely held in the stapler assistor without any free play.

A cover member 5, having an aperture 5a configured to fit a user's hand, is secured to the lower handle portion 1b and fixed thereto by a stopper screw 5b. The position of the cover member 5 is adjustable in the longitudinal direction along the lower handle portion Ib so as to allow the gripping condition to be adjusted in accordance with the size of the user's hand.

The upper jaw 1a is provided with lateral walls or protrusions 1c which abut both sides of the stapler 4, thereby preventing the stapler 4 from moving laterally. Such protrusions, however, may be provided on the lower jaw 2a, provided that the height of such protrusions is less than the height of the lower jaw of the stapler 4 so as to prevent any interference between the protrusions and the papers to be bound.

A coiled return spring 7 is disposed to act between upper handle portion 2b and lower handle portion 1b so as to bias them in an opened position at a constant force. The coiled return spring 7 thereby ensures the stapler assistor is reset during use.

In the second embodiment shown in FIG. 2, the lower surface of the lower jaw 2a and the lower surface of the lower handle portion 1b are flush and coplanar with each other when the stapler assistor is in the open state. The stapler assistor of this embodiment, therefore, can be placed on a desk so that it can conveniently be used in binding thick paper stacks which may be difficult to lift with one hand. Consequently, the user only needs to lift the end of the stack to be bound and feed it into the space between the upper and lower jaws of the stapler. It is therefore possible to conduct efficiently the stapling work on thick stacks which are not easy to handle by one hand.

Figure 4:
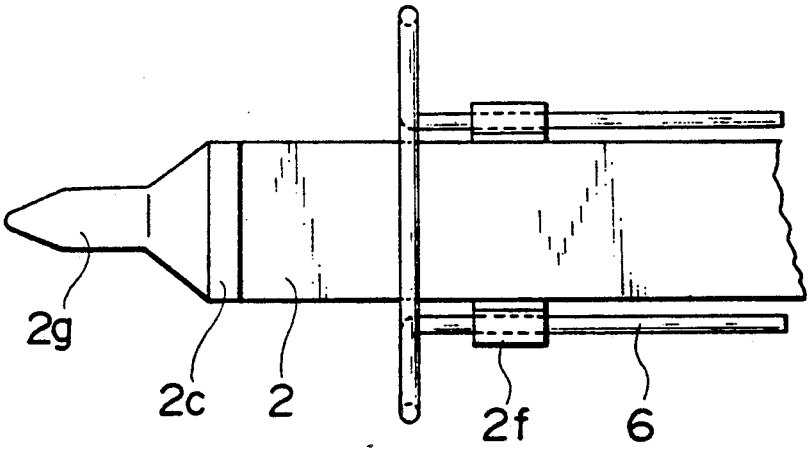
FIG. 4 is a top plan view of a lower jaw in a third embodiment of the stapler assistor in accordance with the present invention.
Figure 5:
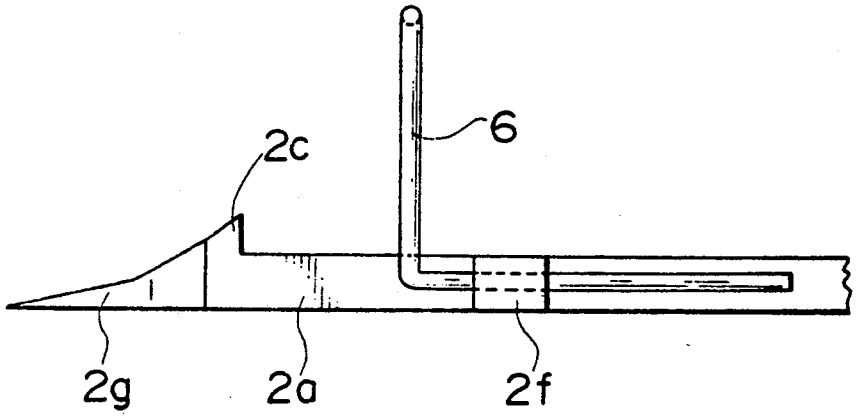
FIG. 5 is a fragmentary side elevational view of a third embodiment of the present invention.

FIGS. 4 and 5 show a third embodiment of the stapler assistor of the present invention in which the lower jaw 2a has a tapered portion 2g which is reduced in height towards the front end thereof. When the user pushes the stapler assistor forward, the tapered portion slides under the object to be stapled, while simultaneously lifting the workpiece. Thus, the object to be bound is easily received in the space between the upper and lower jaws of the stapler 4. The taper may be formed on the lever 2 or, alternatively, a detachable taper member 2g may be formed and used as required.

The base end of the tapered portion 2g has a width which is slightly smaller than the width of the U-shape of the staple. The tapered portion 2g, therefore, can be used as a remover. The remover can easily be used with a large manual force because the remover is provided on the front end of the stapler assistor and, hence, does not require reversing of the stapler assistor.

The lower jaw 2a is provided on both lateral sides thereof with bosses 2f having through-bores extending in the longitudinal direction of the stapler assistor. These through-bores receive a bent wire or bar 6 as shown in FIGS. 1, 3, 4 and 5. The bent wire or bar 6 serves as a stopper which limits the depth of insertion of the object into the stapler.

The stopper 6 is movable back and forth so as to provide any desired depth of insertion as in the case of ordinary hand-held staplers.

Figure 6:
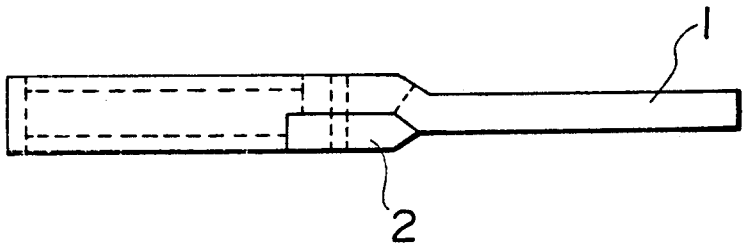
FIG. 6 is a top plan view of a fourth embodiment of the stapler assistor in accordance with the present invention.
Figure 7:
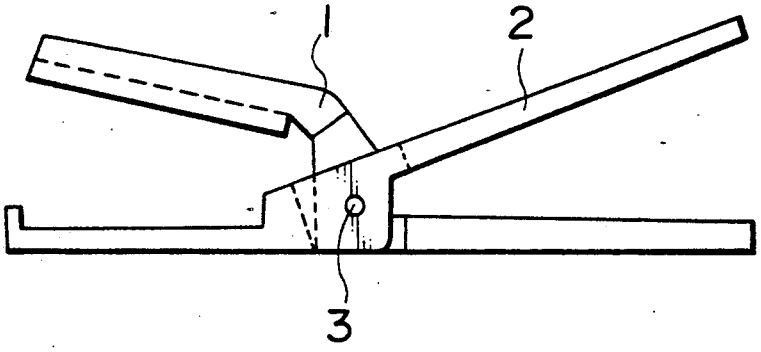
FIG. 7 is a side elevational view of the embodiment shown in FIG. 6.

In FIGS. 1, 2 and 3, the lever 1 is composed of the upper jaw 1a, a handle 1b and side plates 1c which interconnect the upper jaw 1a and the handle 1b. This, however, is only illustrative and, as shown in the fourth embodiment of FIGS. 6 and 7, lever 1 may be formed as an integral member, as in the cases of ordinary tools such as scissors, pliers and so forth.

Figure 8:
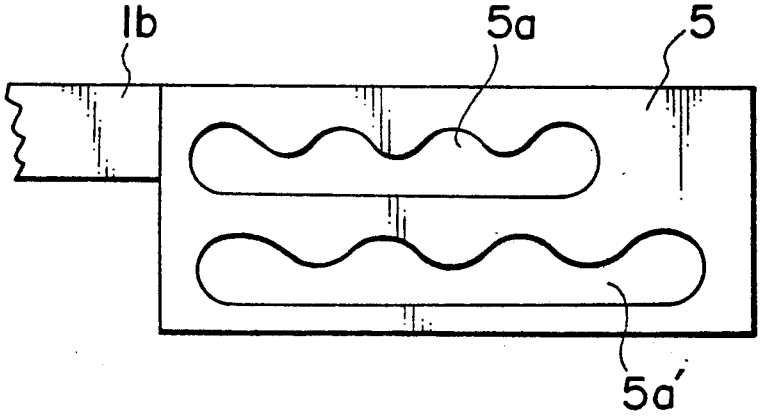
FIG. 8 is a fragmentary side elevational view of a handle portion in a fifth embodiment of the stapler assistor in accordance with the present invention.

FIG. 8 is a fragmentary side elevational view of a fifth embodiment in which the cover member 5 is attached to the handle 1b and has two stages of apertures 5a and 5a'. The aperture 5a is intended for users whose hands are comparatively small, while the second aperture 5a' is for users whose hands are comparatively large in size.

Referring again to FIGS. 1 and 3, the setting of the stapler 4 in the stapler assistor is conducted in the following manner. The stapler 4 is moved into the space between the jaws of the stapler assistor until the remover 4b on the rear end of the stapler 4 is caught in the slit 2d. The stapler 4 is further moved backward while being lightly pressed from the full-open position against the force of the return spring in the stapler 4, as the upper and lower sides of the stapler 4 are pressed by the jaws of the stapler assistor. When the remover on the rear end of the stapler 4 is fully received in the slit 2d, the front lower edge 4a of the stapler 4 clears the projection 2c. In this state, the upper and lower sides of the stapler 4 bear against the upper and lower jaws of the stapler assistor by the force of the stapler's return spring, so that the stapler is tightly held on the stapler assistor.

Removal of the stapler 4 from the stapler assistor, which becomes necessary for loading the stapler 4 with staples, can easily be conducted. The user is required only to slightly lift the front lower edge 4a of the stapler 4 and move the stapler forward so as to extract the remover on the rear end of the stapler 4 from the slit 2d. The stapler 4 can then be extracted without difficulty due to the force of the return spring of the stapler 4 which acts to forwardly drive the stapler 4.

In binding a stack of paper sheets or the like, the stack is brought into the nip between the jaws of the stapler 4. The user then grips the handle 1b at the aperture 5a with four fingers, while the root portion of the thumb is placed on the upper side of the handle 2b. When the user grips the handles and squeezes them toward each other, the stapler is driven by a full gripping force, thereby avoiding finger fatigue.

When the position of the fulcrum 4c of the jaws of the stapler 4 and the position of the fulcrum 3 of the jaws of the stapler assistor do not accord each other, a slip occurs between the upper surface of the upper jaw of the stapler 4 and the lower surface of the upper jaw 1a of the stapler assistor. This slip, however, does not cause a problem. Obviously, the slip can be avoided by designing the stapler assistor such that the positions of the above mentioned fulcrums, 3 and 4c, accord each other.

In the embodiment shown in FIG. 1, the jaw opening limiting abutment comprises a stud bolt with a lock nut. This, however, is only illustrative and the abutment for limiting the opening of the jaws may be provided by forming the base portions of the upper jaw 1a and lower jaw 2*a* in such a manner as to leave a predetermined gap h therebetween.

The embodiment shown in FIG. 1 has a remover 5*c* on the front lower end of the cover member 5. Remover 5*c* has a width slightly smaller than the inside width of the U-shape of a staple. Cover member 5 covers the lower handle portion 1*b* and has a finger-retaining aperture.

From the foregoing description, when a stapler is used with the stapler assistor of the present invention, the user can exert a full gripping force, because the four fingers can stably grasp the handle 1*b* while the root portion of the thumb retains the upper side of the handle portion 2*b*. It is therefore possible to obtain a large staple driving force while avoiding fatigue of the fingers.

The embodiment shown in FIG. 2 can stably be placed on a desk or the like without interference, so that binding is possible without moving the object to be stapled. The lower handle 1*b* in the embodiment shown in FIG. 1 can be gripped with four fingers other than the thumb, so that the whole stapler assistor can stably be held. In addition, the handle opening can easily be adjusted in accordance with the size of the user's hand. In the embodiment shown in FIG. 8, finger-retaining apertures are provided for selection according to the size of the user's hand. For instance, a user whose hand is comparatively small can grip the handle in the upper aperture, while a user having a larger hand can grip the handle at the lower aperture.

In the embodiment shown in FIG. 1, a remover 5*c* is provided on the front end of cover member 5. When removing staples, the user holds the stapler assistor and aims the remover 5*c* at the staple to be removed. Providing the remover on the front end of cover member 5 eliminates the necessity for reversing the stapler assistor, allowing for concentration of the removing force.

The adjustable stopper for limiting the depth of insertion of the paper sheets or the like into the stapler comprises a bent bar 6. The bent bar 6 is slidably received at its ends in bores formed in the bosses 2*f* provided on both sides of the lower jaw 2*a*. Furthermore, the bent bar 6 is bent at its intermediate portions to bridge over the upper jaw 1*a*. The stopper can conveniently be used when stapling consecutive stacks of paper sheets at a constant position, because the sheets can automatically be located by the stopper to ensure that the staples are driven at the constant positions.

The embodiment in which the front end of the lower jaw is tapered to reduce its width and height towards its front end is advantageous in that the front end can receive the object to be bound simply by pushing the assistor forward so that the tapered portion slides beneath the workpiece.

Although the invention has been described through its specific forms, it is to be understood that the described embodiments are only illustrative and various changes and modifications may be imparted thereto without departing from the scope of the present invention, which is solely limited by the appended claims.

I claim:

1. A stapler assistor for assisting the driving and holding of a stapler apparatus, said stapler apparatus having a V-shaped opening with a maximum opening angle and a staple remover at the rear end thereof, comprising:

a first lever having an upper jaw at one end thereof and a lower handle at the opposite end thereof;

a second lever having a lower jaw at one end thereof and an upper handle at the opposite end thereof, said lower jaw having a slit therein for receiving the staple remover of said stapler apparatus, said upper and lower jaws defining therebetween a V-shaped opening for receiving said stapler apparatus with the V-shaped opening of said stapler apparatus oriented in the same direction as the V-shaped opening defined by said upper and lower jaws, said first and second levers crossing each other at intermediate portions thereof, the V-shaped opening between said upper and lower jaws having a maximum opening angle;

a shaft pivotally connecting said first and second levers at said intermediate portions;

a stopper projection, said stopper projection being located on a front end of said lower jaw, said stopper projection retaining said stapler apparatus between said upper and lower jaws;

a plurality of protrusions formed on at least one of said upper and lower jaws, said protrusions preventing said stapler apparatus from moving laterally within said upper and lower jaws; and a stopper formed from a bar slidably received in longitudinal through-bores formed in bosses provided on both sides of said lower jaw and bent at intermediate portions so as to bridge over said upper jaw, said stopper limiting the depth of insertion of an object into said stapler.

2. A stapler assistor according to claim 1, further comprising abutment means secured to said first and second levers, said abutment means limiting the maximum angle of the V-shaped opening defined by said upper and lower jaws to an angle which is smaller than the maximum opening angle of said stapler apparatus.

3. A stapler assistor according to claim 1, further comprising a return spring having an upper end attached to said upper handle and a lower end attached to said lower handle, said return spring urging said upper and lower handles away from each other.

4. A stapler assistor according to claim 1, wherein said lower handle includes a lower surface and said lower jaw includes a bottom surface, and wherein said lower surface is flush and coplanar with said bottom surface when said V-shaped opening is opened to the maximum opening angle of the stapler assistor.

5. A stapler assistor according to claim 1, wherein said lower jaw is provided with a tapered staple remover having a front end, the taper on said staple remover having reduced height and width towards the front end thereof.

6. A stapler assistor according to claim 1, further comprising a cover member attached to said lower handle, said cover member being provided with a finger-retaining aperture.

7. A stapler assistor according to claim 6, wherein said cover member comprises a plurality of openings of varying sizes for accommodating hands of different sizes.

8. A stapler assistor according to claim 6, further comprising locking means for securing said cover member at a desired position along the length of said lower handle.

9. A stapler assistor according to claim 6, further comprising a staple remover secured to said cover remover.

10. A stapler assistor for assisting the driving and holding of a stapler apparatus, said stapler apparatus having a V-shaped opening, comprising:

a first lever having an upper jaw at one end thereof and a lower handle at the opposite end thereof;

a second lever having a lower jaw at one end thereof and an upper handle at the opposite end thereof, said upper and lower jaws defining therebetween a V-shaped opening for receiving said stapler apparatus with the V-shaped opening of said stapler apparatus oriented in the same direction as the V-shaped opening defined by said upper and lower jaws, said first and second levers crossing each other at intermediate portions thereof;

a shaft pivotally connecting said first and second levers at said intermediate portions;

a stopper projection, said stopper projection being located on a front end of said lower jaw, said stopper projection retaining said stapler apparatus within said upper and lower jaws;

a plurality of protrusions formed on at least one of said upper and lower jaws, said protrusions preventing said stapler apparatus from moving laterally within said upper and lower jaws; and a stopper formed from a bar slidably received in longitudinal through-bores formed in bosses provided on both sides of said lower jaw and bent at intermediate portions so as to bridge over said upper jaw, said stopper limiting the depth of insertion of an object into said stapler.

* * * * *

UNITED STATES PATENT AND TRADEMARK OFFICE

CERTIFICATE OF CORRECTION

PATENT NO. : 5,183,196

DATED : February 2nd, 1993

INVENTOR(S) : Mitsuo MIYASHITA

It is certified that error appears in the above-identified patent and that said Letters Patent is hereby corrected as shown below:

On the Title Page:

Please include the foreign priority information as follows:

-- [30] Foreign Application Priority Data

June 29th, 1991 [JP] Japan ..... 80413/1991 --

Signed and Sealed this

Twenty-third Day of November, 1993

*Attest:*

*Attesting Officer*

BRUCE LEHMAN

*Commissioner of Patents and Trademarks*